United States Patent [19]

Smith et al.

[11] 4,300,684

[45] Nov. 17, 1981

[54] GLAZIERS POINT AND RETAINING MEANS

[75] Inventors: James D. Smith, Newington; Roger J. Salvas, Terryville; Ralph B. Shaw, Manchester, all of Conn.

[73] Assignee: The Fletcher-Terry Company, Farmington, Conn.

[21] Appl. No.: 140,242

[22] Filed: Apr. 14, 1980

[51] Int. Cl.[3] ..... B65D 83/00; A47F 7/00

[52] U.S. Cl. ..... 206/493; 206/338; 411/460; 411/461; 211/57.1

[58] Field of Search ..... 206/493, 348; 411/460, 411/461; 211/54.1, 57.1, 59.1

[56] References Cited

U.S. PATENT DOCUMENTS

| | | | |
|---|---|---|---|
| 230,632 | 8/1880 | Hubbard | 206/338 X |
| 1,764,882 | 6/1930 | Newquist | 411/460 |
| 2,841,281 | 7/1958 | Lefebvre | 206/493 |
| 3,762,541 | 10/1973 | Hinden et al. | 206/338 X |
| 4,059,190 | 11/1977 | Conway | 211/57.1 |

*Primary Examiner*—Steven M. Pollard

*Attorney, Agent, or Firm*—McCormick, Paulding & Huber

[57] ABSTRACT

A unique triangular point for use by a glazier has a star shaped central opening such that a plurality of such points can be stacked in oriented relationship to one another, and can be retained by a cotter key having skewed legs such that the key is easily inserted in opposed notches of the aligned openings in the points, and such that the key can be twisted for removal when inserting the stack of points in a conventional point driver. A plastic retainer is also disclosed and is adapted to fit into the aligned openings of the stacked points.

15 Claims, 16 Drawing Figures

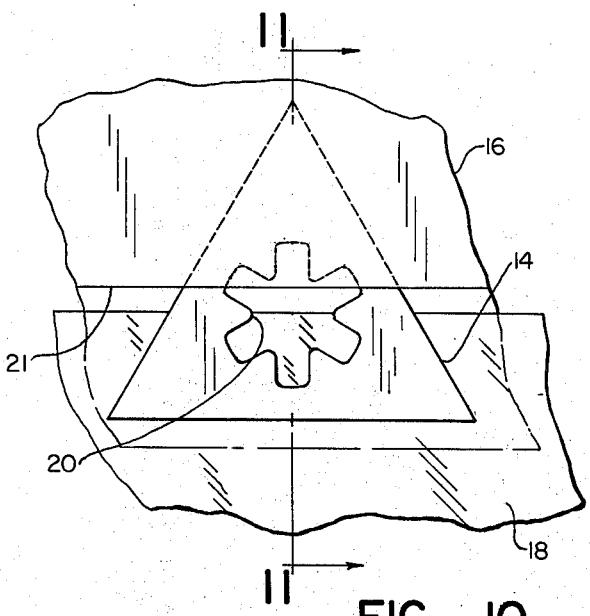
FIG. 10
FIG. 11
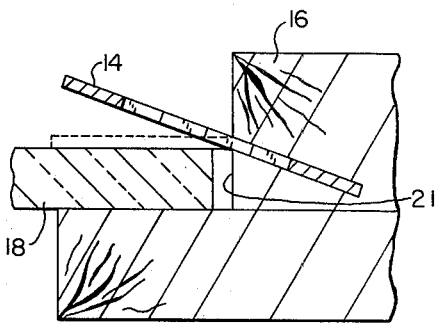
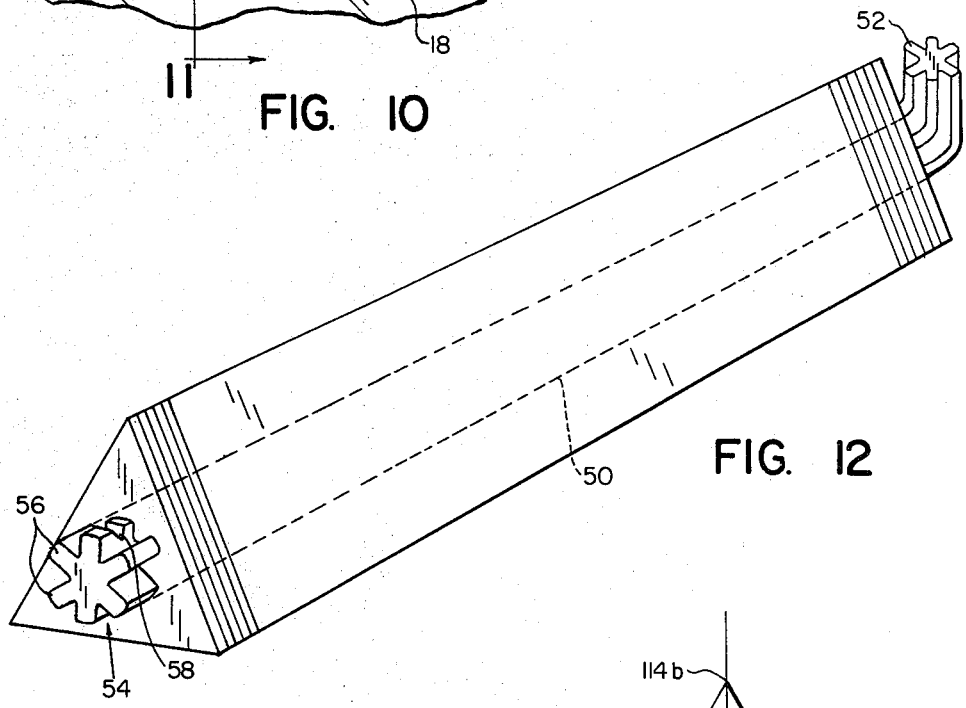
FIG. 12
FIG. 13
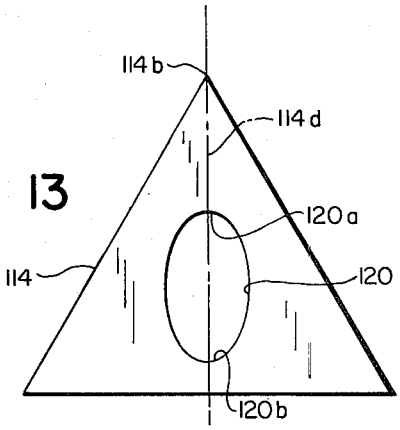

GLAZIERS POINT AND RETAINING MEANS

SUMMARY OF THE INVENTION

This invention relates generally to polygon shaped glazier's points of the type used by glaziers to retain a pane of glass in a wood frame or the like, and deals more particularly a unique means for retaining such points in a stack, particularly points of the type having a non-circular central opening suitable for receiving key defining ribs on the retaining means itself.

Prior art glazier's points are generally stamped from sheet metal or the like, and do not have openings. In accordance with the present invention the points are provided with holes or openings of particular configuration, and these holes have notches which are aligned with the vertices of the generally polygon shaped point such that the points can be conveniently oriented with respect to one another, not only by the tooling used during fabrication, but also during assembly with a retainer of the present invention, such that a stack of points so retained is well adapted to insertion in the magazine of a conventional point driver.

One object of the present invention is to provide an improved point such that it can be driven by conventional means into the wooden molding of a picture frame or the like at a slight angle with respect to the backside of the glass, or picture, or backing material used in the picture frame, following which the exposed portion of the point can be bent downwardly to abut the back of these materials and to better retain these materials in place in the picture frame.

Another advantage of the unique point configuration can be attributed to the use of these points in glazing window frames such that the exposed portion of the point will have a non-circular central opening as mentioned previously, with the result that the glazing material or putty will form a mechanical lock with the opening in the point and thereby provide a more secure window sash assembly.

Still another advantage of the unique point configuration disclosed herein can be attributed to the fact that the exposed portion of the point will more easily permit a workman to retract such points should this be necessary in order to remove a particular piece of window glass in a sash as described above for replacement or the like.

Finally, and still with respect to the unique point configuration disclosed herein, it is noted that the non-circular opening in each of the points permits the points to be oriented and indexed during manufacture of the points themselves, a result not heretofore convenient with conventional points generally.

With reference to the retaining means used for handling a stack of such points, it is noted that no adhesive is required between these adjacent points in order to keep the points in oriented relationship so that they can be inserted in a conventional point driver magazine. The retainer of the present invention provides a mechanical connection between all of the points in the stack such that the points are kept in oriented alignment with one another by the unique retaining means itself.

A further advantage of the point retaining means resides in the fact that such retaining means is expendable and can be easily removed by the glazier while inserting a stack of points in his point driving tool.

The advantages of the point with its associated opening of non-circular contour can best be realized when these points are arranged in a stack and are retained in this stacked configuration by a unique fastener means which includes, an elongated shank extending through the non-circular aligned openings of the points in the stack, a head portion of the fastener configured to abut the endmost point of the stack, and with releasably point engaging means at the opposite end of the shank portion to releasably retain the stack axially by engaging the endmost point at the opposite end of the stack. The shank portion of the fastener has key defining ribs extending axially thereof and cooperating with opposed notches of the non-circular openings in the individual points in order to restrain the points from rotating with respect to one another in the stack.

In one version the fastener is formed by a single injection molded part which is upset at one end to provide for retention of the points on the shank portion thereof. In an alternative embodiment the fastener comprises a one-piece metal member bent to a generally U-shape similar to a cotter key and having its shank portion defined by the legs of the U, which legs have opposed marginal edges defining the above mentioned rib, and which legs are skewed with respect to one another when the cotter key fastener is in its unstressed configuration. In this last version laterally outwardly projecting tabs adjacent the ends of each of said skewed legs serve to retain the stack axially, and the unique configurations of the openings in the points, together with the skewed legs of the cotter key fastener, permit the glazier to twist this type of fastener slightly in order to facilitate removal of this retainer device from a stack of points in order to facilitate insertion of the stack in a point driver or the like.

BRIEF DESCRIPTION OF THE DRAWINGS

FIG. 10 is a plan view of a point identical to that shown in FIG. 1 but inserted into a wooden frame or the like so as to retain a sheet of glass or the like. Portions of the wood frame and glass are shown broken away in this view.

FIG. 11 is a sectional view taken generally on the line 11—11 of FIG. 10, and

FIG. 12 is a perspective view similar to FIG. 9 above but illustrating a slightly different form for the point retaining means illustrated specifically in FIGS. 2 and 3 above, the retaining means of FIG. 12 comprising an integral plastic injection molded part which can be used in much the same manner as that described above with reference to the retaining means of FIGS. 2 and 3, except that the plastic retaining means of FIG. 12 need not be twisted in order to be removed from the point driver magazine as described above with reference to FIGS. 6, 7 and 8.

FIG. 13 is a plan view of a glazier's point of alternative geometry, but incorporating many of the advantages of the FIG. 1 point.

DETAILED DESCRIPTION

Figure 8:
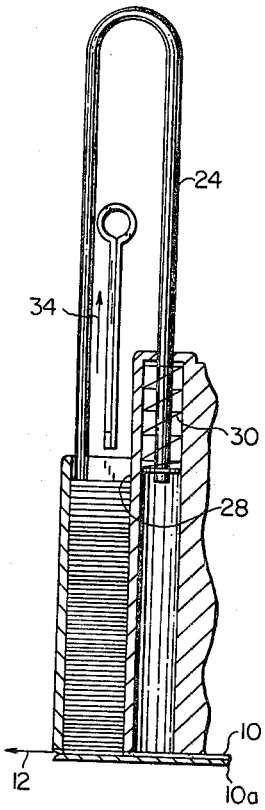
FIG. 8 is a view similar to FIGS. 6 and 7, to illustrate the final step in the process of inserting a stack of points held by the retaining means in accordance with the invention disclosed herein, and shows the retaining means being withdrawn and separated from the stack of points.

Glazier's points are, typically, triangular or diamond shaped, and are commonly provided in stacked configuration with a suitable adhesive or the like between adjacent points in the stack, not unlike the stacking of staples for a staple gun. Furthermore, conventional point drivers or the like are available for driving the lowermost point in a stack from a magazine, and U.S. Pat. No. 1,744,700 shows a typical point driver of present day construction. In use, the point driver would be placed against the surface of a window glass, after the glass has been suitably located in a window sash or frame, and after a certain amount of glazing material or putty had been first provided in the window sash all in accordance with conventional practice. After applying the point driver to the surface of the glass as aforesaid, the glazier squeezes a trigger such that a point driving plate drives the lowermost point from the stack into the wood style or frame of the window assembly. Such point drivers are also utilized by picture frame manufacturers who also drive points into a wooden picture frame molding without the benefit of putty or glazing material. FIG. 8 of the drawings illustrate the magazine portion of a typical point driver wherein the lowermost point in the stack is adapted to being driven by a plate 10 in the direction of the arrow 12 so as to embed the point in the adjacent wood picture frame or window sash. FIGS. 10 and 11 illustrate a triangular point 14 of the present invention after it has been so driven into a wood picture frame 16. In FIG. 11, the point 14 is shown in solid lines after having been so driven by the driver, and it is noted that the driver will have been held at a slight angle to the plane of the glass 18 in order to achieve the orientation shown. After having been so driven the point 14 is sometimes bent to the broken line position shown in FIG. 11, with the result that the point is deformed along a line 21 defined by the edge of the wooden frame 16.

Figure 1:
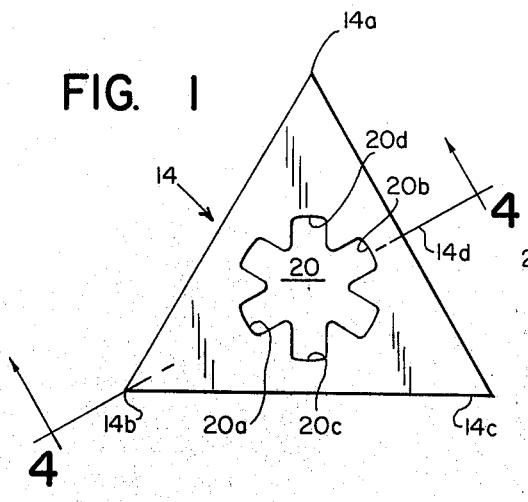
FIG. 1 is a plan view of a triangular glazier's point constructed in accordance with the present invention.

The preceding discussion will set the frame of reference for the present invention, and illustrates the typical use made of a conventional point as well as that intended for the point to be described herein. In accordance with the present invention, and also in accordance with the conventional practice of manufacturers of points generally, the typical glazier's point comprises a regular polygon shaped metal element, which in FIG. 1 is of triangular plan-form having three vertices 14*a*, 14*b*, and 14*c*. The line 14*d* comprises a bisector of the vertex angle defined at 14*b*, and it will be apparent that three such bisector lines can be visualized for the triangular point shown. In accordance with the present invention the point 14 has a non-circular opening 20 defined centrally thereof and the bisector 14*d* is so oriented that notches 20*a* and 20*b* of the opening 20 are oriented symmetrically with respect to this bisector line 14*d* and are located on said line 14*d*, with further notches 20*c* and 20*d* being oriented on other bisector lines associated with other vertices of the triangular shaped point. Thus, pairs or sets of opposed notches are defined in the noncircular opening 20, corresponding in number to the number of such vertices in the regular polygon shaped point. For example, the triangular point 14 in FIG. 1 has three such pairs of notches. It is further noted that the regular polygon shaped point 14 is not only triangular, but is also equilateral in that the lengths of the three sides are equal to one another. It will also be noted that the noncircular opening configuration has a maximum lateral dimension oriented along at least one bisector of at least one vertex of the polygon plan form.

Figure 4:
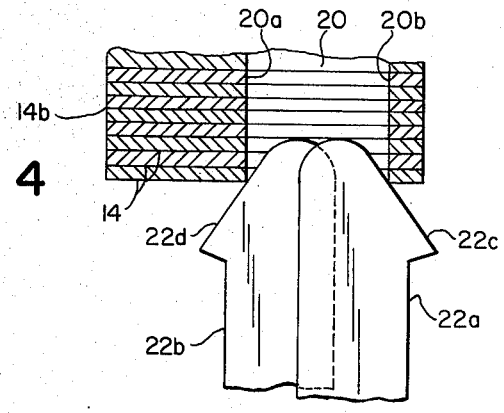
FIG. 4 is a sectional view illustrating a stack of points, all similar to the point of FIG. 1, and this view is taken generally on the line 4—4 of the triangular point illustrated in FIG. 1 but with an end portion of the retaining device from FIG. 2 also shown being inserted into the aligned point openings.
Figure 4A:
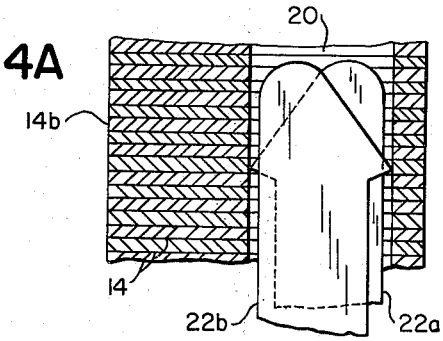
FIG. 4*a* is a view similar to FIG. 4 at a slightly later instant of time with the same end portion of the retaining means illustrated in an intermediate position during insertion of the retainer into the aligned openings of the stack of points.
Figure 4B:
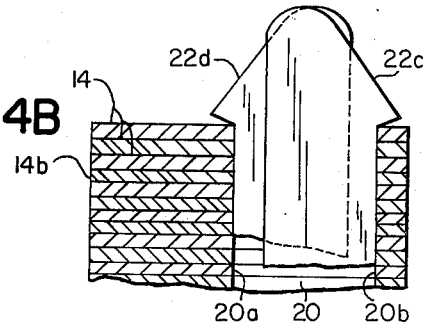
FIG. 4*b* is a view similar to FIGS. 4 and 4*a* but showing the retaining means after it has been fully assembled with the stack of points to retain them in aligned positions with respect to one another.

The above described configuration for the opening 20 in the triangular point 14 permits piloting of a plurality of such points in suitable tooling mechanism (not shown) such that the points can be assembled in a jig or the like and stacked as suggested in FIG. 4. Such an assembly is designed to allow suitable point retaining or fastener means to be inserted into the aligned openings as suggested in the sequence of views illustrated in FIGS. 4, 4*a* and 4*b*.

Figure 2:
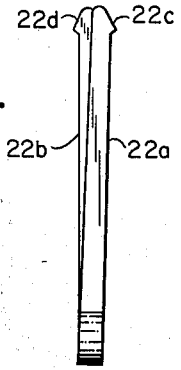
FIG. 2 is a front elevational view of one presently preferred form for the point retaining means such that a stack of points can be retained in aligned, and oriented, relationship with respect to one another.
Figure 3:
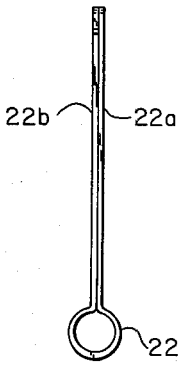
FIG. 3 is a side view of the retaining means shown in FIG. 2.

Turning next to a description of the particular fastener means illustrated in detail in FIGS. 2 and 3, the fastener shown comprises a metal strip bent back along itself in a generally U-shape so as to define a head portion 22, adjacent leg portions 22*a* and 22*b*, and each of such leg portions is preferably skewed slightly with respect to the other, as shown in FIG. 2, for a purpose to be described. As best shown in FIG. 4 the ends of these legs 22*a* and 22*b* for the shank portion of the fastener illustrated in FIGS. 2 and 3 have the appearance of being anti-symmetrical with respect to one another, and the end of each leg defines an out-turned tab portion, 22*c* and 22*d* respectively, such that these ends serve to retain the stack axially once the fastener of FIGS. 2 and 3 has been inserted through the entire stack as suggested in FIG. 4*b*.

Figure 6:
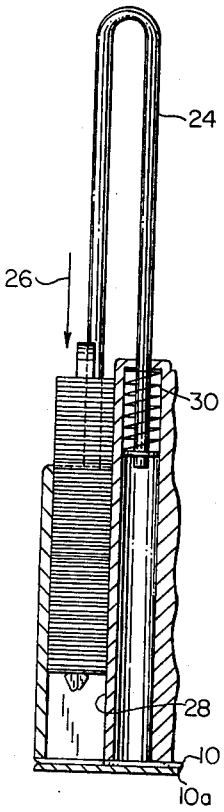
FIG. 6 is a schematic view of the magazine portion of a conventional point driver with the point driver bail being swung to one side in order to admit a stack of points with an associated retaining means of the type illustrated in FIGS. 2–5*a* above.

As so assembled the combination of the stack of triangular points 14, 14 together with the associated fastener just described provides a convenient combination well suited to insertion into the magazine of a conventional point driver. FIG. 6 shows the magazine portion of such a point driver with the bail 24 moved to one side and out of the way of the magazine so as to permit insertion of the stack of points as indicated generally by the arrow 26. The magazine itself is illustrated at 28, and comprises a receptacle of generally triangular configuration for receiving triangularly shaped points, and may be made of other shape for receiving points of different configuration. As suggested in FIG. 7, once the stack of points has been inserted into the magazine to the extent indicated in that view one can move the bail 24 into position for holding the stack downwardly as a result of pressure from bail return spring 30 in the point driver, with the result that the head portion 22 of the retainer or fastener can be twisted counterclockwise as indicated by the arrow 32 in FIG. 7 while such retainer is also withdrawn vertically in the upper direction as indicated by the arrow 34 in FIG. 8.

Figure 5A:
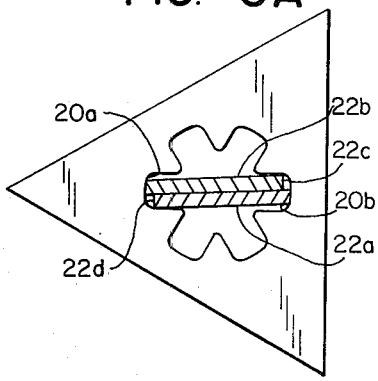
FIG. 5*a* is a view taken generally on the line 5*a*—5*a* of FIG. 5.
Figure 5:
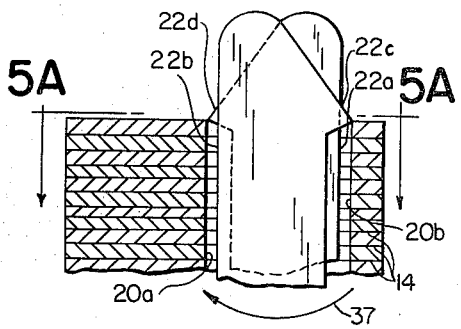
FIG. 5 is a view similar to FIG. 4*b* except that the retaining means is indicated as being twisted in a counterclockwise sense preparatory to removal from the stack of points.

It is an important feature of the present invention that projecting tabs 22*c* and 22*d* of the fastener retainer will not impede this withdrawing motion suggested in FIG. 8 by reason of the cooperation between these projecting tabs and the configuration for the opening 20 in the lowermost point in the stack. The relative geometry is such that these projecting tabs will not impede withdrawal of the fastener as suggested in FIG. 8 but will tend to enhance this withdrawal step. FIG. 5 shows that the leg portions 22*a* and 22*b* of the fastener will tend to move away from their normal skewed position in response to twisting motion in the direction of the arrow 37 in FIG. 5, which arrow is in the same sense as the arrow 32 in FIG. 7. FIG. 5*a* illustrates the relationship between the corners of the notched portions 20*a*, 20*b* for the opening and the projecting tab portions 22*c* and 22*d* for the fastener legs.

Figure 9:
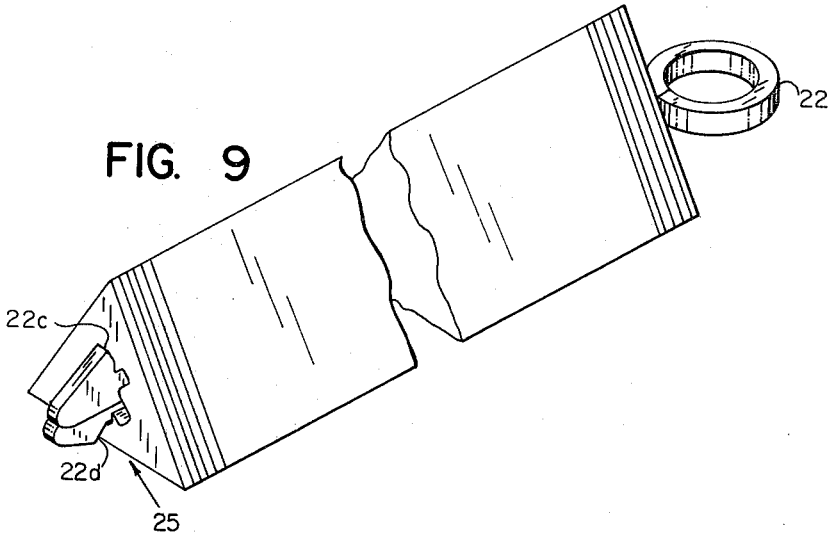
FIG. 9 is a perspective view, with a portion of the stack of points being broken away, showing the head and the opposite end portion of the retaining means described hereinabove with reference to FIGS. 2–8.

With particular reference to FIG. 9 the head of the fastener of FIGS. 2 and 3, protrudes from one end of the stack of points, while the opposite end of the fastener projects through the opposite end of the stack of points as suggested at 25. It will be apparent that counterclockwise twisting motion imparted to the head 22 of the fastener will result in a torsional force being applied to the legs 22*a* and 22*b* of the fastener such that the protruding end portions thereof, indicated generally at 25, will be urged into contact with one another and the projecting tabs 22*c* and 22*d* will cam on the notched portions of the opening 20 and thereby facilitate removal of the fastener 22 from the stack as suggested in FIG. 8. The bail 24 of FIG. 8 can be inserted into the magazine once the fastener has been so removed, and the point driver used in conventional fashion. The stack of points are held down against conventional stops at the bottom of the magazine and each can be driven individually from the bottom of the stack as suggested by the arrow 12 in FIG. 8 by a conventional mechanism suitable for driving the plate 10 of the point driver itself. It should perhaps be noted that this stack of points will actually function more efficiently in such a conventional point driver than was true of a conventional stack because the latter stacks are held together with adhesive or the like, and this adhesive material tends to interfere with operation of the point driver after long periods of use. In fact, point drivers have had to be cleaned periodically with a suitable solvent in order to remove buildup from such adhesive. This disadvantage does not present itself with the unique point stack assembly of FIG. 9.

A shoe 10*a* is provided at the toe of the point driver and below the magazine described above so that the point driver itself can be held against the surface of the glass to drive the point into a wood sash such as shown in FIG. 10 at 16. The opening 20 in the point 14 will have a portion thereof which does not penetrate the wood sash 16, and this result will permit a workman to more easily withdraw the point after it has been so driven when required.

With particular reference to FIG. 11, the edge 21 of the sash 16 into which the point 14 is driven can be used to help the workman pry the point out as described above. Further, and as shown in FIG. 11 by the broken lines for the exposed or projecting portion of the point 14, the driven point may be installed at an angle to the glass pane 18 so that the point can be bent downwardly about the line defined by the intersection of edge 21 and the member 18 (which may or may not be glass). This feature is facilitated with the improved point 14 as a direct result of hole 20 in that this bending step (popular with picture frames and the like) is made much easier. The hole 20 weakens the point along the desired bend line, with the result that the angled point is more easily bent downwardly parallel to the plane of member 18 as suggested in FIG. 11.

Figure 7:
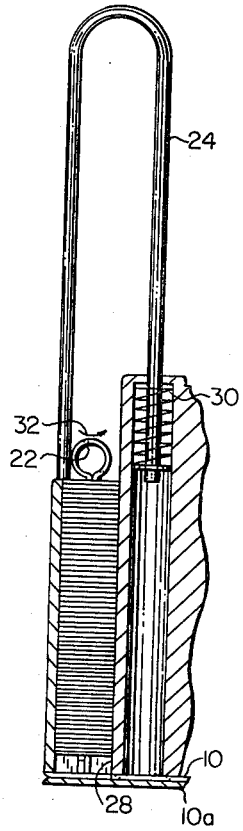
FIG. 7 is a view similar to FIG. 6 but showing the retaining means for the stack of points being twisted in a counterclockwise sense as suggested in FIG. 5 above, and with the point driver bail holding the stack of points downwardly so that the retainer can be moved upwardly as suggested in FIG. 8.

Finally, FIG. 12 shows an alternative embodiment for the fastener element or retaining means for a stack of points similar to the stack depicted in FIG. 9. The fastener 50 of FIG. 12 has a head portion 52 (which may be formed by permanently bending the otherwise straight fastener shank portion as shown) and an opposite end 54 which projects beyond the endmost point in the stack as shown. This fastener 50 is preferably formed by injection molding, or by other means such as molding in an extrusion die, from a thermoplastic material. Preferably from a plastic capable of being formed to a permanent set at one end 52 to provide a head, and also adapted to being upset at the opposite end 54 to form a releasable point engaging means to retain the stack of points axially. As shown in FIG. 12, this plastic fastener 50 has the same cross sectional configuration as the generally star shaped opening 20 in each of the stacked points, and this cross section provides a plurality of ribs 56, 56 extending axially of the fastener and filling each of the notches provided in the aligned point openings. To form the above described releasable point engaging means at the end 54 of fastener 50 one of these ribs is mechanically upset as shown in FIG. 12. The raised rib regions adjacent the upset portion 58 will keep the points from moving or sliding off the shank of fastener 50, but once the assembly of FIG. 12 has been placed in the magazine of a point driver, such as shown in FIGS. 6, 7 and 8, one can very easily strip the fastener from the stack as outlined previously with reference to the cotter key type fastener of FIG. 9. One need not even twist the fastener 50 to remove it as suggested for the preferred embodiment. Indeed, such twisting motion is not necessary with the FIG. 9 assembly but is merely preferable. The projections 22*c* and 22*d* at the end of 25 of FIG. 9 fastener are relieved to allow it too to be stripped from the stack without twisting.

Turning next to the glazier's point of FIG. 13, this point 114, like that described with reference to FIG. 1, has a regular polygonal planform (preferably triangular) and defines an opening 120 which has opposed notch portions 120*a* and 20*b* oriented on a bisector line 114*d* associated with one vertex 114*b* of the triangular shaped point. As so constructed and arranged the noncircular opening 120 is generally elliptical in outline and well suited to receive a retainer of the type described above with reference to FIGS. 2 and 3. This fastener or retainer can be received in a stack of such points and can be inserted as described with reference to FIGS. 4, 4A, 4B, 5, and 5A. A stack of such points can readily be loaded in a point driver magazine as suggested in FIGS. 6, 7 and 8.

We claim:

1. A glazier's point for use in wood to retain a glass pane in place for glazing, said point comprising a flat metal plate of multi-sided planform and defining an opening extending therethrough.

2. The glazier's point as defined in claim 1 wherein said multi-sided flat metal point is of polygon planform, and wherein said opening is of non-circular configuration and has a maximum lateral dimension oriented along at least one bisector of at least one vertex of the polygon planform.

3. The glazier's point as defined in claim 2 wherein said polygon has at least three sides, and wherein said maximum dimension of said opening more particularly comprises opposed notches located on said bisector.

4. In combination with a stack of glazier's points each said point in the stack being as defined in claim 3, the improvement comprising fastener means for retaining the said stack of points in assembled relationship, said fastener means including an elongated shank portion extending through the non-circular openings of said points in said stack and including a head so configured as to abut the endmost point in said stack, and said fastener means further including releasable point engaging means at the end of said shank portion opposite said head to retain the stack axially, said fastener shank portion having at least one key defining rib extending axially thereof and cooperating with said opposed notches of said non-circular openings of said individual points to restrain the points from rotating with respect to one another in said stack.

5. The combination defined by claim 4 wherein all points in said stack are identical to one another, each such point having its non-circular opening defining several pairs of opposed notches, said pairs of opposed notches corresponding in number to the vertices of the polygonal point planform, each said pair of opposed notches oriented on a bisector of one of the vertices of said polygonal point planform.

6. The combination defined by claim 5 wherein each of said vertex bisectors defines a line of symmetry for each point in said stack, and wherein all of said notches in all of said points are aligned with one another in the assembled stack to receive the key defining shank portion of said fastener means in any one of a plurality of orientations.

7. The combination defined by claim 6 wherein said shank portion of said fastener means comprises a molded plastic portion defining a plurality of key defining ribs, said ribs slidably fitting in at least some of said notches in said aligned point openings.

8. The combination defined by claim 7 wherein said fastener means head is integrally formed with said shank, and wherein said releasable point engaging means comprises at least one of said ribs being upset adjacent the last point in the stack to provide resistance to axial disassembly of said fastener from said stack.

9. The combination defined by claim 8 wherein the numbers of key defining ribs corresponds to the number of notches in the openings of said points.

10. The combination defined by claim 9 wherein said fastener means head has the same cross sectional shape as that of said shank portion, said head formed by a laterally offset portion of said shank.

11. The combination defined by claim 6 wherein said fastener means comprises a one piece metal member bent to a generally U-shape and having said shank portion defined by the legs of the U, said legs having opposed marginal edges which define at least two of said key defining ribs.

12. The combination defined by claim 11 wherein said legs are skewed slightly relative to one another, and said means at the end of said shank portion opposite the head of said fastener means more particularly comprising laterally outwardly projecting tabs adjacent the ends of each of said skewed legs stack axially, and said skewed legs having tapered tips or ends to allow said shank portion to enter said non-circular opening upon assembly with said stack by causing said skewed legs to move into closer alignment with one another with the result that said legs tend to resiliently return to said skewed configuration and to cause said tabs to move outwardly of the last point in the stack to releasably engage it as aforesaid.

13. The combination defined by claim 12 wherein said legs are so configured upon assembly with said stack of points that said head can be twisted about the axis defined by said aligned point openings to overcome the resilient return (restoring) force which tends to skew said legs to facilitate disassembly in a point driver or the like.

14. The combination defined by claim 4 wherein said shank portion of said fastener means comprises a molded plastic portion defining a plurality of key defining ribs, said ribs slidably fitting in at least some of said notches in said aligned point openings.

15. The combination defined by claim 4 wherein said fastener means comprises a one piece metal member bent to a generally U-shape and having said shank portion defined by the legs of the U, said legs having opposed marginal edges which define at least two of said key defining ribs.

* * * * *